US005186463A

United States Patent [19]

Marin et al.

[11] Patent Number: 5,186,463

[45] Date of Patent: Feb. 16, 1993

[54] METHOD OF PLAYING A LOTTERY GAME

[76] Inventors: Thomas C. Marin, 2050 Geoffrey Dr., Willow Grove, Pa. 19090; Scott J. Fields, 163 Orchard Ct., Blue Bell, Pa. 19422; Stephen B. Richter, 1620 Norristown Rd., Ambler, Pa. 19002

[21] Appl. No.: 707,119

[22] Filed: May 29, 1991

[51] Int. Cl.[5] ..... A63F 3/06

[52] U.S. Cl. ..... 273/138 R; 283/903

[58] Field of Search ..... 273/139, 138; 283/101-102, 901, 903

[56] References Cited

U.S. PATENT DOCUMENTS 4,842,278 6/1989 Markowicz ..... 273/138 A

*Primary Examiner*—Benjamin H. Layno

*Attorney, Agent, or Firm*—Synnestvedt & Lechner

[57] ABSTRACT

A method for playing a lotto type lottery game. The method comprises the following steps: selling a first plurality of lottery tickets for a lotto style lottery game in which prizes are paid out at both the jackpot and sub-jackpot levels; drawing a first winning combination; and selling a second plurality of tickets for a subsequent game such that said first plurality of lottery tickets may be reutilized for the jackpot prize level of a subsequent drawing.

1 Claim, 3 Drawing Sheets

METHOD OF PLAYING A LOTTERY GAME

FIELD OF INVENTION

The present invention is directed to lotto type gambling games. In particular, the present invention is directed to a novel lotto type lottery game which enables players to reutilize their lotto tickets between jackpot drawings.

BACKGROUND OF THE INVENTION

Lotto has gained great popularity in both the United States and abroad. Today, legal lotto games are conducted in over 35 states and Canadian provinces as well as internationally in over 25 countries. Lotto is a major source of revenues for the states and provinces which sponsor lotteries.

Lotto is a gambling game in which the wagerer must correctly pick a pre-set quantity of numbers to be drawn from a larger pool of numbers. In most lotto games, the player fills out computer coded cards with selected number combinations. The cards are then presented to a authorized lottery dealer. Lotto tickets containing the one or more selected sets are then generated by a computerized ticket generator and purchased by the player. Lotto ticket generators typically contain random number generators, such as that disclosed in U.S. Pat. No. 4,665,502. These numbers randomly select number sets for players who do not choose to pick their own number combination.

At the time of the drawing (which is televised in many jurisdictions), the numbers (usually printed on balls) are withdrawn from a pool using number selection devices such as those disclosed in U.S. Pat. Nos. 4,583,736; 4,796,890 and 4,813,676. The balls are drawn without replacement (i.e., after a particular number is drawn, it is not returned to the pool and cannot be redrawn). If a preset number of the withdrawn balls corresponds to the numbers preselected by the player on a particular ticket, the player wins a cash prize. Currently existing lotto games pay cash awards in instances where a player picks all of the drawn numbers (corresponding to a jackpot), as well as those instances in which a player has picked less than all of the numbers, for example when the player has correctly picked 4 out of 6 or 5 out of 6 numbers of the selected combination.

Lotto tickets are typically purchased in two ways. Initially, players can code up a computer readable card with their number selections. Alternatively, lottery tickets are purchased by players who permit random ticket generators to generate their tickets. The selected numbers are then transmitted to a central computerized system which stores the selected numbers (as well as those coded up by the players), each of which correspond to a purchased ticket.

At the time of the drawing, the central governing authority, which is typically a state contractor, can thereby quickly determine whether one or more jackpot prizes has been awarded, and can further determine the number and distribution of sub-jackpot prizes.

A particular problem which has faced numerous jurisdictions which sponsor lotto games is that of declining revenues and profits. There are a number of state lottery agencies which are running deficits due to increased competition for players. With the proliferation of lotteries, states and Canadian provinces have aggressively campaigned to receive a larger share of static lotto revenues.

In addition, it is common for lotto jackpots to accumulate over many weeks. Accordingly, players frequently wait until a jackpot has grown to a substantial level before beginning to purchase tickets. Thus, the size of the jackpot is directly proportional to the demand for tickets. This phenomenon tends to create an inconsistent cash-flow for the lottery authority and frequently leads to frenzied buying at the last minute as the jackpot accumulates. This situation can result in people waiting in line for many hours to purchase tickets, disrupts the business of the ticket vendor, and discourages the elderly and infirm from purchasing tickets.

It would be desirable to provide a novel lotto style lottery game which would increase player interest and which would help to increase the revenues of a lottery which adopted the game. It would be particularly desirable to provide a novel lotto type lottery game which permits players to reutilize lottery tickets for more than one drawing. Such a system would encourage players to purchase tickets early in a lotto jackpot cycle by enabling them to re-utilize their tickets for subsequent drawings. The present invention provides a system in which the demand for tickets occurs from the first drawing. The novel lotto game of the present invention can be easily implemented in currently existing on-line lotto ticket systems.

A principal object of the present invention then is to provide a novel lottery game which incorporates a jackpot ticket carryover provision which is designed to radically increase player participation and interest.

It is a further object of the present invention to provide a novel lotto game which facilitates the potential for payment of cash prizes for losing tickets during a multiple sequence of drawings.

It is still a further object of the present invention to provide a novel lotto type lottery game which can be easily implemented with existing on-line lotto systems.

These and other objects of the present invention will become apparent from the Summary and Detailed Description which follow.

SUMMARY OF THE INVENTION

In accordance with the present invention a method for playing a lotto type lottery game comprising: selling a first plurality of lottery tickets for a lotto style lottery game in which prizes are paid out at both the jackpot and sub-jackpot levels; drawing a first winning lotto combination; and selling a second plurality of tickets for a subsequent game such that said first plurality of lottery tickets may be re-utilized for at least one prize level in said subsequent drawing.

DETAILED DESCRIPTION OF THE PREFERRED EMBODIMENT

Figure 1:
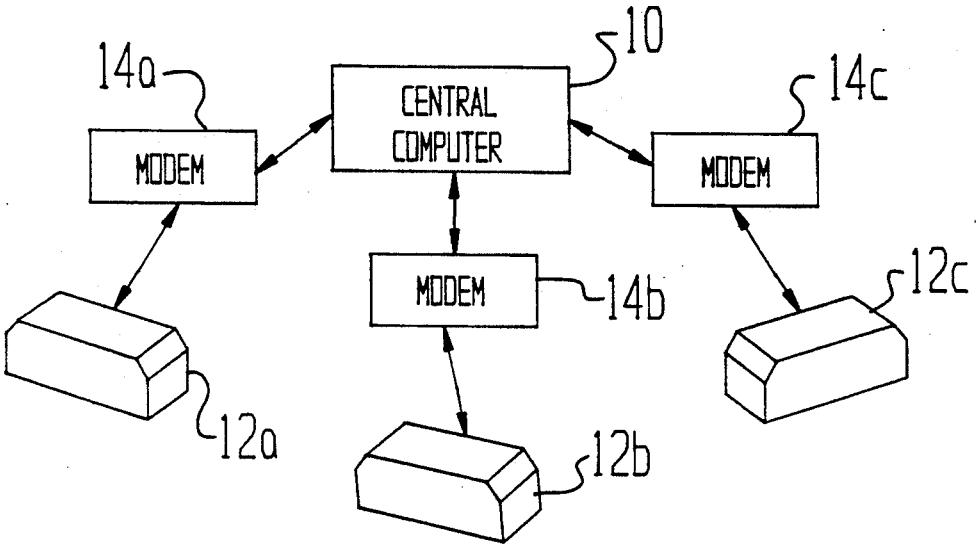
FIG. 1 is a block diagram of an on-line system in accordance with the present invention.

The present invention is described with reference to the enclosed Figures wherein the same numbers are utilized where applicable. FIG. 1 illustrates an on-line lottery system for a state such as Delaware. The present invention and system will be described in the context of a 36 number pick-6 lottery, but the principles of the present invention are applicable for Pick-5, Pick-6, Pick-7 and all other "Pick type" lotteries of all pool sizes, including so-called "Keno type" configurations such as the Pennsylvania Jul. 10, 1974 game or the Michigan Oct. 22, 1980 game.

The novel lotto type lottery game of the present invention utilizes conventional on-line apparatus and systems which are currently widely utilized within the United States and Canada. Such a system utilizes a central or host computer center 10 which services a plurality of on-line lottery vendors 12*a*, 12*b*, 12*c*. The central host 10 is preferably located at a lottery contractor or at the state or provincial lottery headquarters. Each on-line unit 12*a*–12*c* is located at a separate location across the state (or across several states in the case of multi-state lotteries) in, for example, grocery stores, liquor stores, and the like. Each unit 12*a*–12*c* functions independently of the other units and is typically independently operated by a sales agent or a vendor, generally the store owner, who sells the lottery tickets as part of his business, receiving a percentage of the purchase price of each ticket sold from the state agency which runs the lottery.

Each unit 12*a*–12*c* is placed independently and selectively in two-way communication with the central computer center 10 through a respective modem 14*a*, 14*b*, 14*c*. The central computer is preferably a powerful computer under the control of a high level CISC or RISC based microprocessor and should preferably be capable of multi-tasking and multi-processing capabilities. Each modem 14*a*, 14*b*, 14*c* is advantageously positioned within its associated unit 12*a*–12*c* at the particular location, or alternatively, adjacent thereto.

Advantageously, each of the modems 14*a*–14*c* is preferably a dial-up modem which is actuated by its own conventional touch-tone telephone circuitry to access a telephone line 15 between each of the modems 14*a*–14*c* and the central computer 10. The modems 14*a*–14*c* permit two-way communication between the central station 10 and the local end stations 12*a*–12*c*.

In accordance with the present invention, each unit 12*a*–12*c* independently records each ticket sale and stores sales data indicating at least the number of tickets sold and, more generally, the numbers, types and prices of different tickets sold. Central computer 10 operates as a central data processor to perform all of the necessary accounting functions, including determining such information as the volume of sales and money due or from each sales agent at his particular location. The central computer 10 receives periodic updates from the local user stations 12 of the number combinations which have been sold. In this way, the central computer 10, at the time of the drawing, can determine whether a lotto jackpot ticket has been won, as well as determine the number of sub-jackpot prizes. Each local unit 12 will perform accounting functions on its own sales data.

Figure 2:
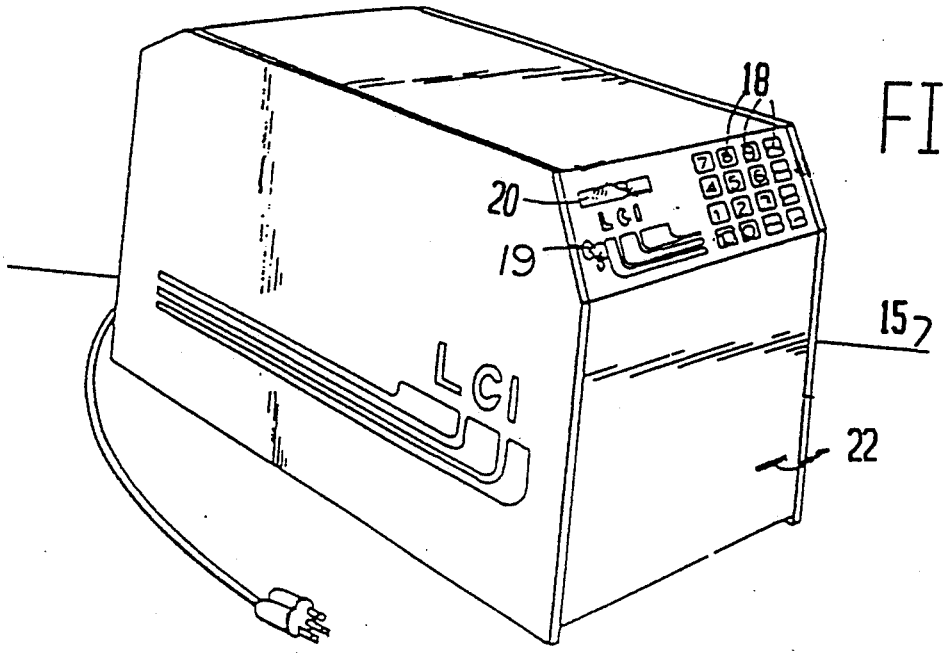
FIGS. 2-2A are perspective views of a local on-line lottery distribution system in accordance with the present invention.
Figure 2A:
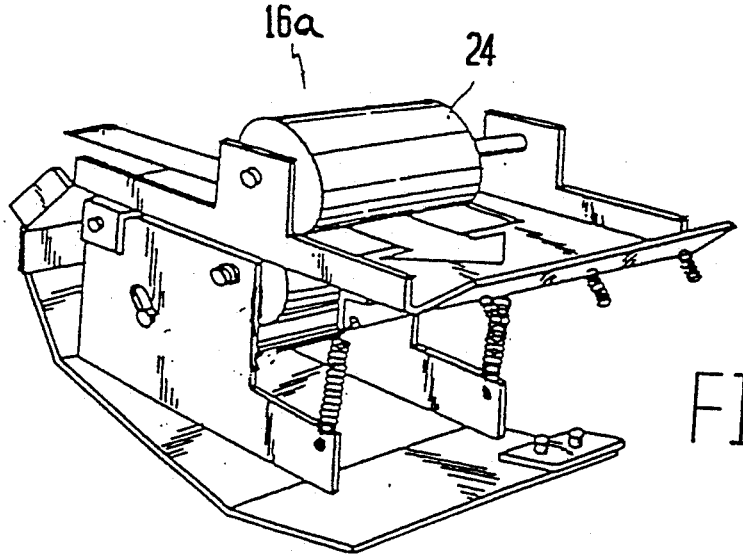
Figure 3:
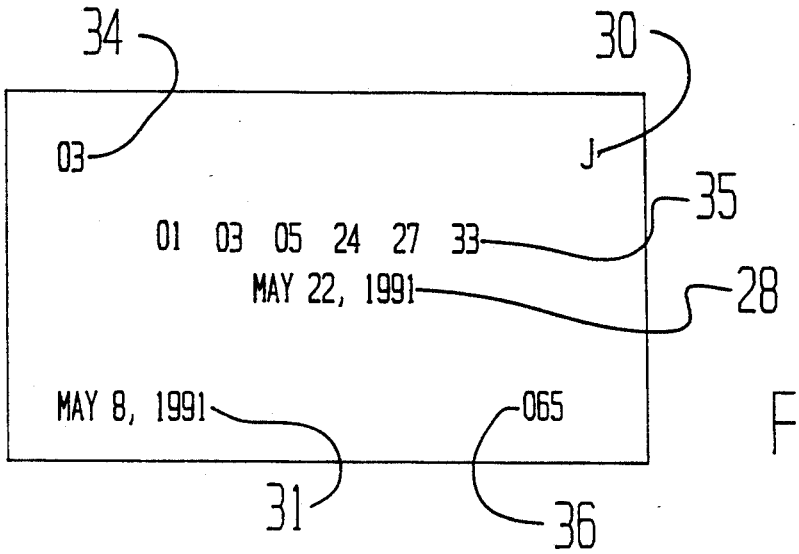
FIGS. 3 and 3A are representations of lotto tickets in accordance with the present invention.
Figure 3A:
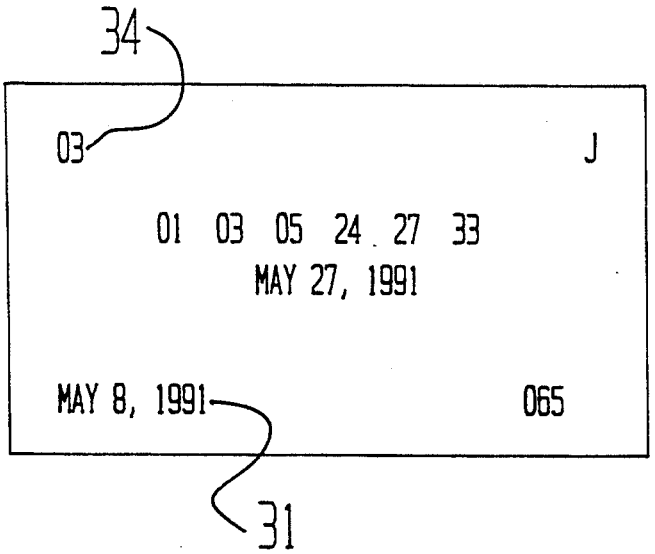

Referring to FIG. 2, unit 12 is preferably constructed as a box-like module 16 designed to rest upon the surface of a counter 15 or the like at the local end station. The module, which is conventional, will include a keypad 18 to punch-in numbers such as the number of tickets requested, an LED/LCD display 20, and a slot 22 to feed in coded-up ticket forms. The device 16 is locked via a key 19. As shown in FIG. 3A, the interior 16*a* of device 16 stores a quantity of rolled ticket stock 24 which is printed as individual tickets are purchased. Modem 14 may be internal or external to device. The device 16 should preferably include a low-power microprocessor capable of facilitating communication between end station 12 and central computer 10. The device 16 will also preferably include a ROM.

The operation of the novel lotto type game of the present invention is now explained. Referring to FIG. 3, when each ticket 26 is purchased at stations 12*a*–12*c*, it is coded with the date of purchase 28 and marking (a letter "J") 30 which indicates whether a jackpot carryover provision is applicable, and the date of the last jackpot award 31. This ticket will preferably also indicate the last date a jackpot ticket was awarded 32. The ticket 26 may further include a coded marking 34 which indicates the sequence in games between jackpot drawings. The ticket 26 will also include a notation 36 corresponding to the vendor from whom the ticket was purchased. The ticket may optionally be barcoded to provide any desired information for validation purposes.

Typically, state lotto drawings are picked weekly. Tickets are typically sold for a drawing beginning approximately four hours following a drawing up until five minutes before the subsequent drawing. The approximate four hour "down time" is used for updating the central computer with the last number combinations purchased prior to the drawing. This period also enables the central computer to run a match check for any jackpot awards. Finally, this period is used by the central computer to issue commands to the local stations 12*a*–12*c* to print the appropriate notations e.g. 30, 31, 32 and 34 on all tickets sold for the subsequent drawing.

Under the novel lotto game of the present invention, tickets purchased following the last drawing in which a jackpot prize was awarded, may be reutilized at any prize level, or alternatively at only the jackpot prize level, for each subsequent drawing until the next jackpot prize is awarded. Thus, if a ticket is purchased for a first drawing and that ticket does not win, the ticket may be reutilized for each subsequent drawing until a jackpot prize is awarded. In many jurisdictions, four to eight weeks may pass before a jackpot ticket is awarded.

By way of example with reference to FIG. 3, assume a ticket 18 having the numbers 1, 3, 5, 24, 27, and 33 is purchased by player X in the morning of Wednesday, May 22, 1991 for a weekly 6 by 36 lotto type lottery game which pays out at the 3/6, 4/6, 5/6 and 6/6 (jackpot) prize levels. The ticket may be purchased either through random ticket generation or by the player coding up the requested number using a ticket dispenser such as device 16. Assume further that a previous jackpot was awarded two weeks earlier on Wednesday, May 8, 1991.

As shown in FIG. 3, the ticket, when purchased, will, in addition to providing the six digit number combination 35, provide a date marking indicating that the last jackpot was awarded on May 8, 1991 31, provide a number indicating the location of the vendor 36, provide a marking indicating that the ticket is initially for the second drawing following the last jackpot 34, and provide a notation "J" 30 indicating that the jackpot carryover rule is in operation. Because a jackpot had been awarded on May 8, 1991, all tickets purchased on or before May 8, 1991 are no longer valid for subsequent drawings.

As noted, the command to apply the above notations are provided by the central computer, which will have previously determined from a match check program whether a jackpot had been won from the previous drawing on May 15, 1991. This information is compiled and processed during the four hour period following the last drawing.

If the winning drawing for May 22, 1991 is 1, 7, 9, 13, 18 and 25, the contracting or state authority will initially determine whether a jackpot was won through a match check at central host computer 10. In making this match check, the computer will check the combinations purchased for both May 15, 1991 and May 22, 1991 with reference to the winning draw. If during the drawing of May 22, 1991, a jackpot had been won, Player X's ticket could not be reutilized on May 29, 1991.

If the central computer determines that no player who purchased tickets for the May 15, 1991 and May 22, 1991 drawings holds a jackpot ticket, the jackpot will rollover for a third drawing on May 29, 1991. Player X's ticket is valid for this drawing. As shown in FIG. 3A, new tickets purchased for this drawing will include the notation that the last winning ticket had been awarded on May 8, 1991 31. However tickets purchased between after May 22–29, 1991 will include the notation 3 34 to indicate that the next drawing is the third in sequence since the last award of a jackpot. The command to change this numeral will be sent to the local stations 12*a*–12*c* by central computer 10 during the four hour down-time period following the drawing.

Assuming that the winning drawing of May 29, 1991 is the combination 1, 3, 5, 24, 29 and 35, Player X will hold a winning 4 out of 6 combination. However, this winning combination could be re-utilized for a subsequent jackpot drawing assuming a jackpot was not won on May 29, 1991, and will be valid for all subsequent drawings until a jackpot is awarded. At the time a jackpot is finally awarded, the ticket may be cashed in for the highest prize level awardable on any drawing between jackpots. Thus, it is possible that on the May 29, 1991 drawing, Player X could hold a five out of six combination.

The jackpot carry over provision thus provides further excitement to the game and permits player of modest means to maximize their opportunities to win. While the present invention has been described in the context of an example in which tickets may be re-utilized at all prize levels, it is to be appreciated that the teachings of the present invention are equally applicable to situations where tickets may only be reutilized for designated prize levels such as the jackpot.

It is to be further appreciated that the novel game of the present invention can be selectively implemented at any time during a sequence of lotto drawings. Thus, the system can be implemented to coincide with various strategic marketing dates such as Labor Day, Columbus Day and Christmas. In addition, the method of the present invention can be implemented in existing lotto style games or form the basis for the creation of a new lotto style game.

What is claimed is:

1. A method for playing a lotto type lottery game comprising:

selling a first plurality of lottery tickets for a lotto style lottery game in which prizes are paid out at both the jackpot and sub-jackpot levels;

drawing a first winning combination; and selling a second plurality of tickets for a subsequent game such that said first plurality of lottery tickets may be reutilized for either the jackpot or a sub-jackpot prize level of said subsequent game, said first and second plurality of tickets containing a code which indicates their sequence between jackpot drawings.

* * * * *